US006022213A

United States Patent [19]

Harthun

[11] Patent Number: 6,022,213

[45] Date of Patent: Feb. 8, 2000

[54] GAS FIRED HEATER

[75] Inventor: Norman E. Harthun, San Carlos, Calif.

[73] Assignee: Paper Machinery Corporation, Milwaukee, Wis.

[21] Appl. No.: 08/886,495

[22] Filed: Jul. 1, 1997

[51] Int. Cl.[7] ..... F23R 3/06

[52] U.S. Cl. ..... 431/158; 431/351; 431/346; 431/353; 431/264

[58] Field of Search ..... 431/158, 10, 354, 431/326, 329, 353, 351, 346, 350, 328, 7, 264; 60/740, 723, 722, 742

[56] References Cited

U.S. PATENT DOCUMENTS 1,466,356 8/1923 Eddison .
3,035,632 5/1962 Ericsson .
3,460,895 8/1969 Yamaguchi .
3,807,940 4/1974 Juricek .
4,082,497 4/1978 Crawford et al. .
4,490,130 12/1984 Konzal et al. .
4,907,964 3/1990 Howarth et al. .
5,472,402 12/1995 Aloisi et al. .
5,544,808 8/1996 Aloisi et al. .

*Primary Examiner*—Carl D. Price
*Attorney, Agent, or Firm*—Foley & Lardner

[57] ABSTRACT

A gas fired low emission air heater for a cup making machine having a combustion chamber and a venturi block mounted on the inlet end of the combustion chamber and having a tapered venturi passage in the venturi block. An air inlet nozzle is aligned with the venturi passage and an annular gas ring formed around the nozzle for directing gas into the venturi passage. A discharge nozzle is mounted on the outer end of the combustion chamber and a metal matt assembly mounted in the combustion chamber. The metal matt assembly including one or more perforated mixing plates and a metal matt aligned with the mixing plates. A spark plug is mounted in the combustion chamber for igniting the gas/air mixture prior to discharge of the heated air into the cup making machine.

5 Claims, 5 Drawing Sheets

GAS FIRED HEATER

FIELD OF THE INVENTION

This invention relates to a machine for the manufacture of two piece paper cups that are coated with thermoplastic material and have fused seams and is more particularly concerned with a gas fired heater for heating those areas of the cup blank at which seams are to be formed.

BACKGROUND OF THE INVENTION

The present invention relates to two piece paper cups produced by machines of the type as shown and described on U.S. Pat. No. 4,490,130, issued in Dec. 25, 1984, and entitled "Machine For Forming Seams Of Two-Piece Paper Cups." In this regard the patent relates to an electrically heated air stream which is directed at a side wall blank and a circular bottom wall blank momentarily at a heating station in the machine. The machine on which the blanks are assembled and formed into a cup has a turret and a number of mandrels that project radially from the axis of the machine and are carried to each of a succession of stations by indexing rotation of the turret. The mandrels taper in the direction away from the turret axis and have at their outer end a flat surface at which there are suction inlet openings.

In the operation of the machine, a flanged bottom wall blank is concentrically attached by suction to the flat end surface of the mandrel, with its flange projecting away from the mandrel. Thereafter, a side wall blank is wrapped around the mandrel and the bottom wall blank. This wrapping brings the marginal side edge portions of the side wall blanks into an overlap relationship with the flange of the bottom wall blanks wherein they can be bonded to one another to form a side seam and a bottom seam. The seams are heated by an electrical heater mounted in a housing as described in U.S. Pat. No. 4,490,130.

SUMMARY OF THE PRESENT INVENTION

The general object of the present invention is to provide, in a paper cup making machine of the character described, a gas heated device operating at a heating station to which each mandrel on the cup forming turret is indexed. The gas heating device applies heat in the form of hot air to the side wall blank and the flange portion of the bottom wall blank as shown and described in U.S. Pat. No. 4,490,130.

More specifically, therefore, it is an object of this invention to provide a paper cup making machine with a heating device which comprises a gas heating element mounted in a fixed position which is not subject to harmful vibrations or accelerations. A movable nozzle is aligned with the heating device through which the stream of air that has passed through the heating device and directed through the nozzle toward the seams of the paper cup blanks. The gas heater maintains a substantially constant and steady flow of air notwithstanding that the nozzle has a pumplike action as it is advanced toward an operative position where it is effective to heat the cup blanks on the mandrel and retracts to an inoperative position where it is well clear of the orbit of the mandrels.

One of the specific objects of this invention is to provide a gas heating device that applies heat to the bottom-seam-forming portions of cup blanks by directing hot air to those portions of the cup blanks to ensure melting of the plastic coating on the outer surface of the flange on the bottom wall blank and also by subjecting the bottom portion of the cup to gas heat, to ensure application of an adequate amount of heat to the cup blanks during the brief period of dwell of the mandrel at the heating station.

Another important object of this invention is to provide a design package of a venturi and metal matt burner integrated in such a way as to eliminate the need for boosting utility gas pressure as it is piped into the air heater. An important feature of the gas/air heater is that it uses a woven metal matt to anchor the flame. In this regard the metal matt enables the air heater to achieve very low carbon dioxide and NOX emissions, even at high temperatures. Direct fired gas heating equipment for use on cup making machines does exist, however none utilize the benefits of a metal matt burner design. Present air heaters rely on older premix, diffusion flame, or direct flame technologies. The air heating process being proposed represents a technological advance from older and more conventional designs.

In general, these objects are achieved in a machine for making two piece flat bottom paper cups of thermal plastic coated paper, each comprising a side wall blank and a disklike bottom wall blank that has its margin formed as a circumferential axially projecting flange, the machine comprising a circular cross-section around which a side wall blank is rolled and which has at its outer end a flat outwardly facing surface against which a bottom wall blank is held with its flange portion projecting outwardly and surrounded by the bottom portion of the side blank. The machine is characterized by a gas heater having a woven metal matt to provide an evenly distributed gas/air mixture to a combustion chamber for melting the coated portions of the blanks to provide for their adhesion to one another.

Other principal features and advantages of the invention will become apparent to those skilled in the art upon review of the following drawings, the detailed description and the appended claims.

Figure 1:
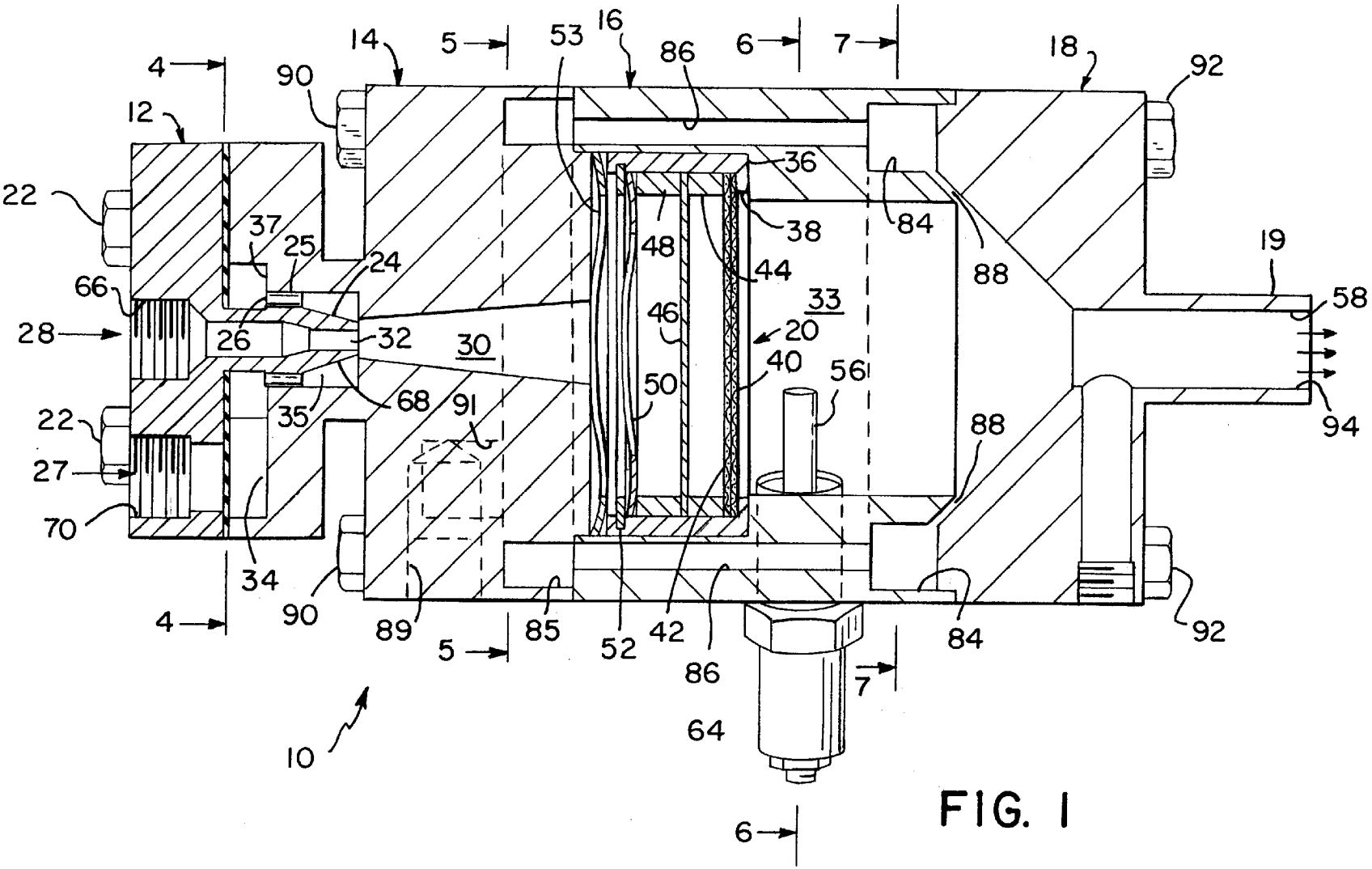
FIG. 1 is a cross-sectional view of the gas heater assembly according to the present invention.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

Figure 2:
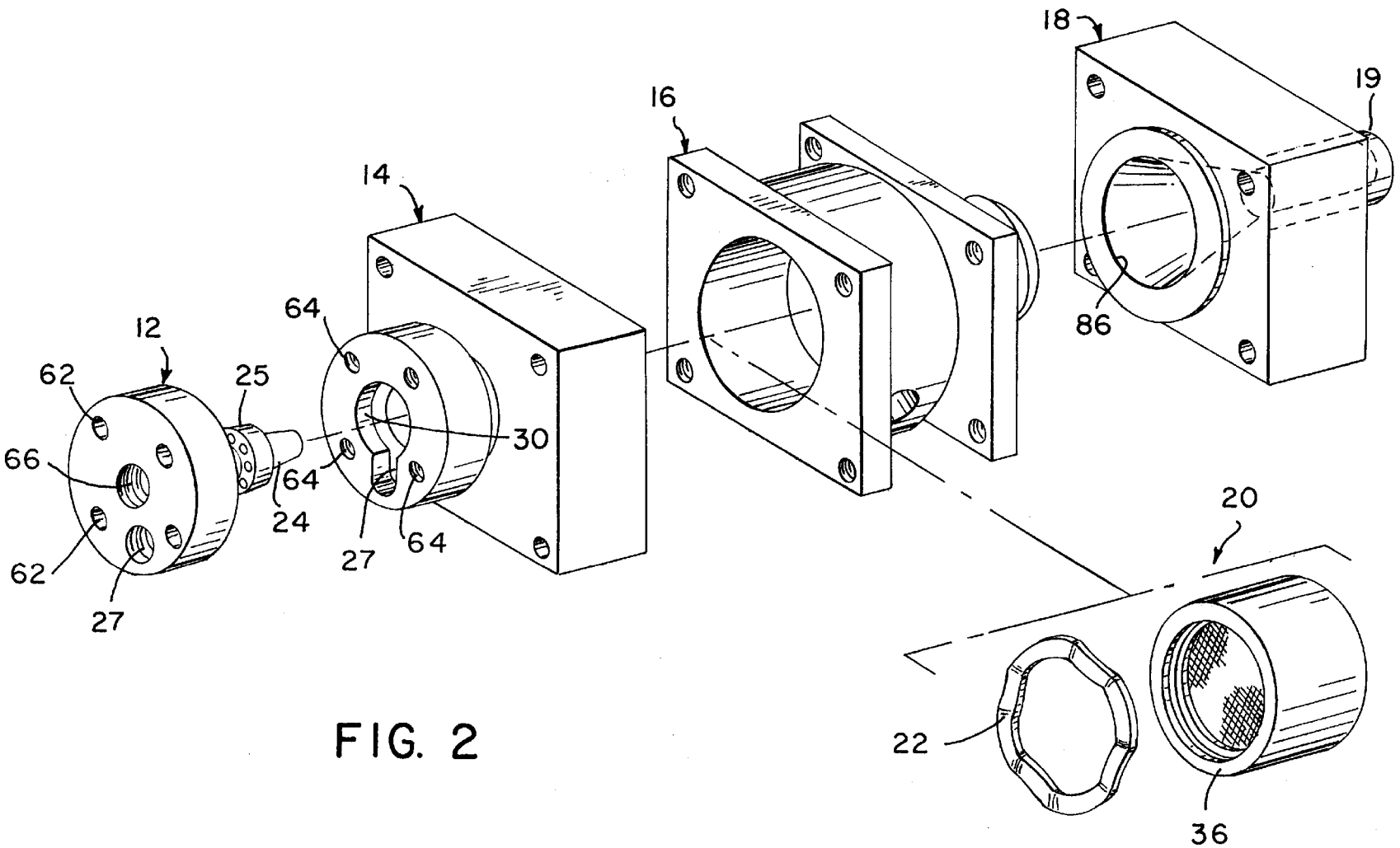
FIG. 2 is an exploded view of the gas heater assembly.
Figure 3:
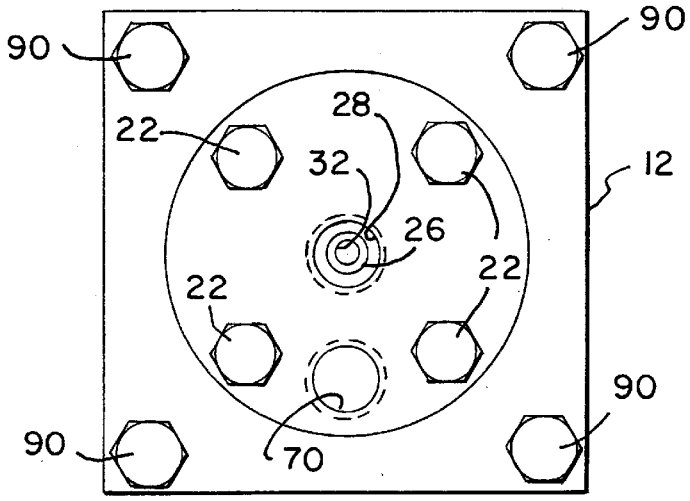
FIG. 3 is an end view of the gas heater.
Figure 4:
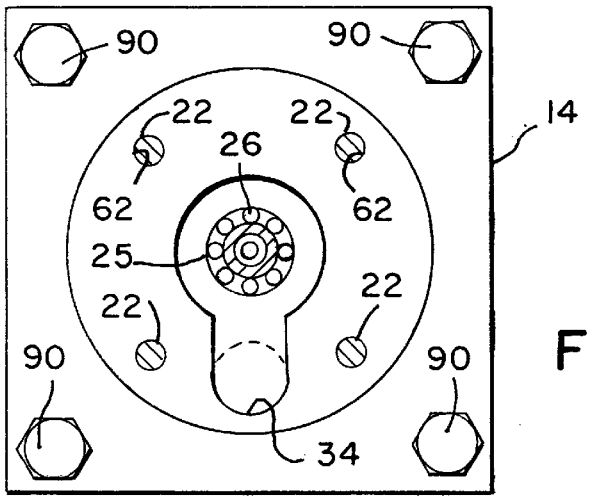
FIG. 4 is a cross-sectional view of the venturi section of the gas heater taken on line 4—4.
Figure 5:
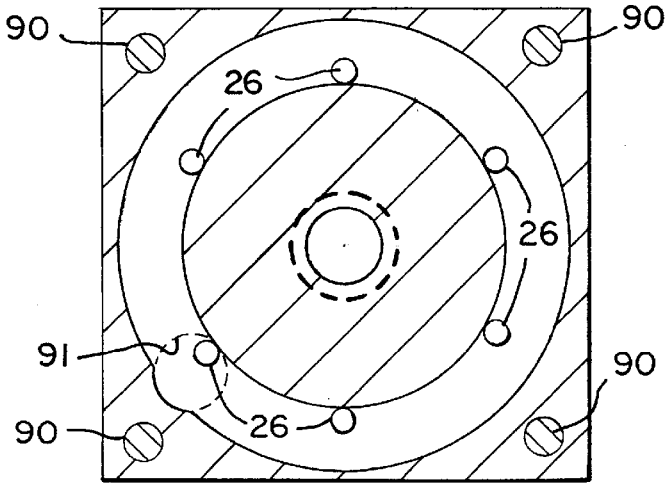
FIG. 5 is a cross-sectional view of a secondary air passage block taken on line 5—5.

The air heater 10 according to the present invention, as shown in FIGS. 1 and 2 generally includes a gas/air inlet block 12, a venturi mixing block 14, a combustion chamber block 16 and a hot air exit block 18 having a nozzle 19 for directing hot air into the cup machine. A burner core assembly 20 is mounted in the combustion chamber block 16. A nozzle 24 is provided on the inlet block 12. A flange 25 having a number of openings 26 is provided around the outside of nozzle 24 for directing gas into a tapered venturi passage 30 in the mixing block 14. In this regard, gas is admitted into passage 27 in the gas/air inlet block 12 and passes through openings 26 in flange 25 and passes into the venturi passage 30 through the gap between the nozzle 24 and the venturi passage 30.

The gas/air inlet block 12 is connected to the venturi mixing block 14 by bolts 22. An air inlet passage 28 is provided in the inlet block 12 which is connected to the passage 32 in nozzle 24. The tapered venturi passage 30 in mixing block 14 is connected to the combustion chamber 33 in block 16.

Figure 8:
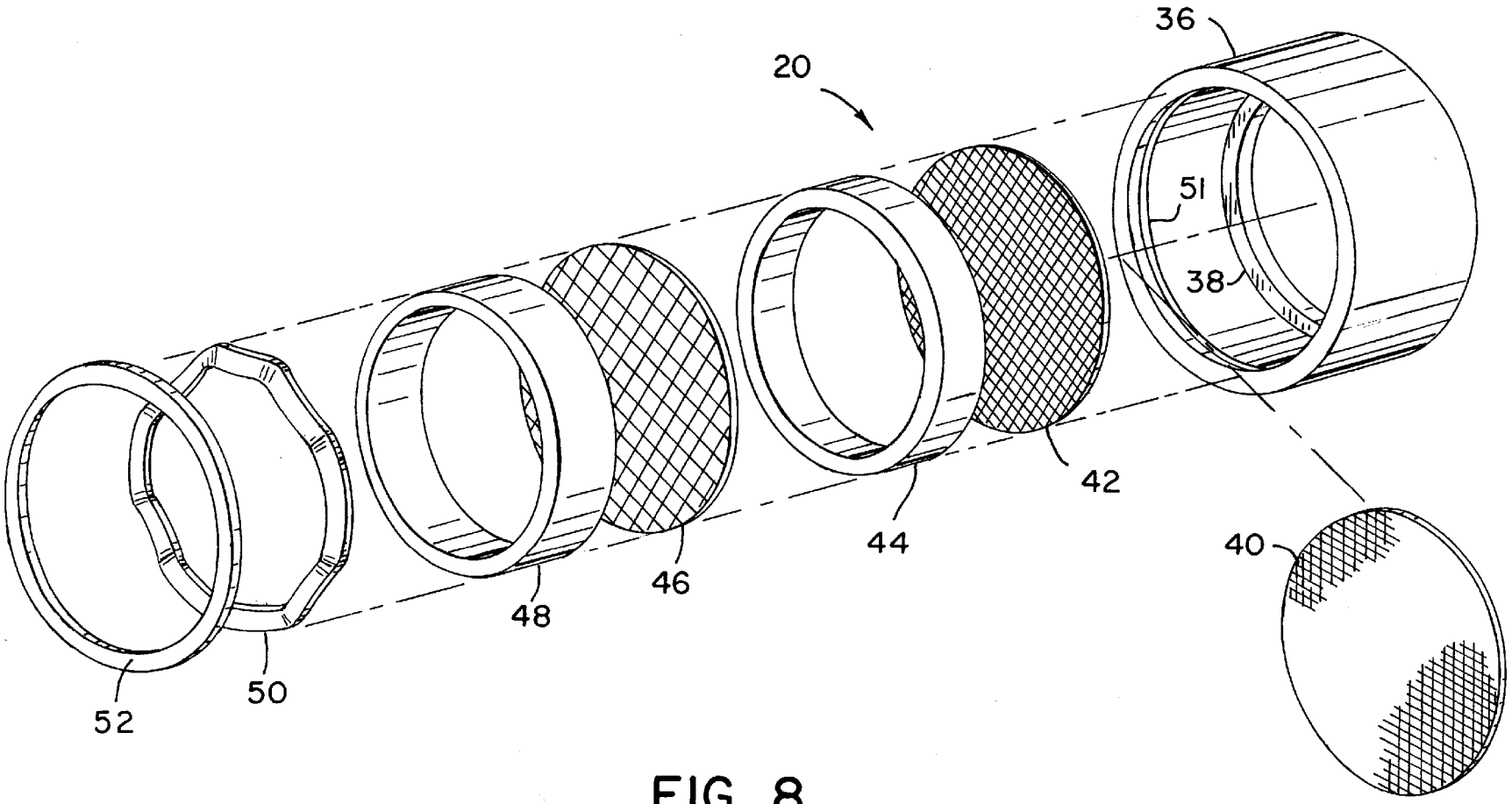
FIG. 8 is an exploded view of the gas/air mixing assembly.

The burner core assembly 20 as shown in FIGS. 1, 2 and 8 includes a circular frame 36 having a ledge 38 around the inner perimeter of the frame 36. A woven metal matt 40 is seated on the ledge 38 in the frame 36. A mixing screen 42 is mounted on the metal matt 40 and maintained thereon by a spacer ring 44. A second mixing screen 46 may be seated on spacer ring 44 and retained thereon by a second spacer ring 48. A wave ring 50 is seated on the spacer ring 48 and retained thereon by a snap ring 52 seated in a groove 51 in frame 36. A second wave spring 53 is provided between the frame 36 and the face of block 14 to seat the frame 36 on the ledge 38.

Figure 6:
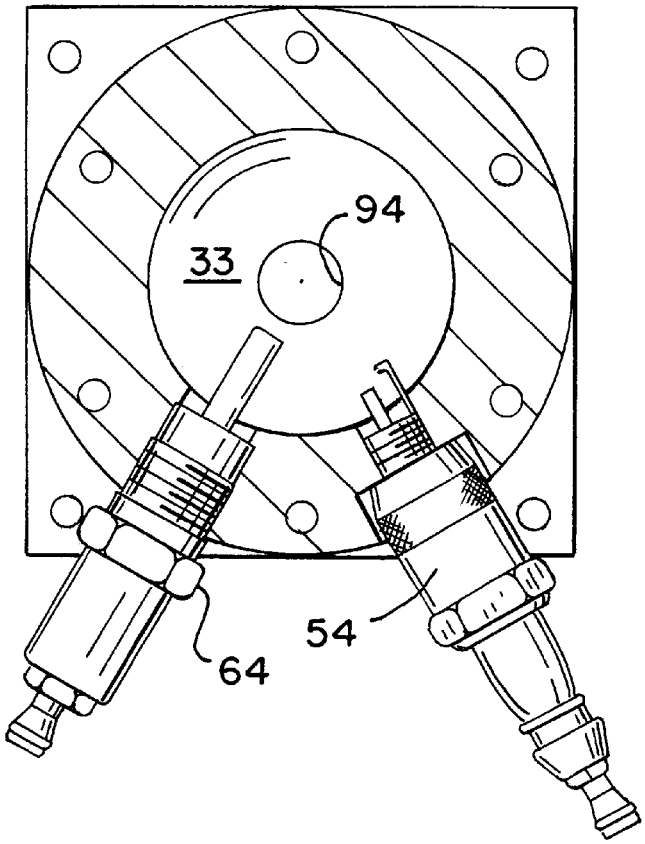
FIG. 6 is a cross-sectional view taken on line 6—6 showing the spark plug and flame sensor control assembly.
Figure 7:
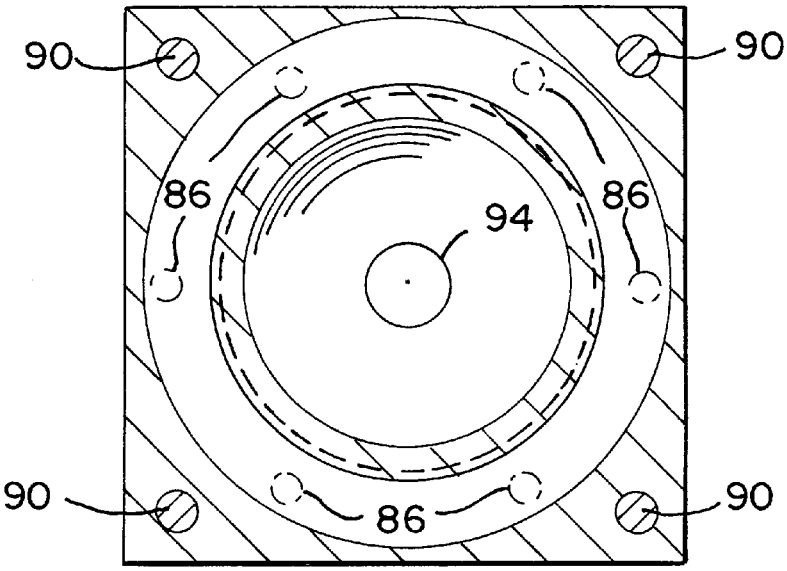
FIG. 7 is a cross-sectional view of the secondary air inlet section taken on line 7—7.

A spark plug 54 as shown in FIG. 6 is mounted in the combustion chamber 33 to initiate combustion of the air/gas mixture in the chamber 33. A flame sensor rod 56 is also provided in the chamber 33 to indicate ignition of the fuel mixture in the chamber. The heated gas/air mixture is discharged through hot air duct 58.

More specifically, the gas/air inlet block 12 is mounted on the venturi block 14 by means of bolts 22 which are aligned with openings 62 in the nozzle block 12 and threaded openings 64 in the venturi block 14. A threaded opening 66 is axially aligned with the tapered venturi passage 30 in the venturi block 14. The nozzle 24 is provided on the inside of the inlet block 12 which is aligned in a spaced relation to the tapered venturi passage 30 in venturi block 14. The threaded inlet passage 27 provided in the inlet block 12 is connected to a passage 34 in the face of the venturi block 14. The passage 34 is connected to the tapered passage 30 in venturi block 14 by means of a circular recess 37 which is connected to opening 35. The flange 25 has a number of equally spaced openings 26 formed around the nozzle 24 which connects the recess 37 to the opening 35 to spread the gas equally around the nozzle 24 and direct the gas into the tapered venturi passage 30. The gas/air mixture is directed into the chamber 33 in the combustion chamber block 16.

The combustion chamber block 16 as shown in FIGS. 1 and 2 includes a ledge 38 in chamber 33 to accommodate the burner core assembly 20 described above. A recess 84 is provided around the downstream side of the combustion chamber block 16 which is connected by passages 86 to a recess 85 in the face of the venturi block 14. The recess 84 is connected to the chamber 33 by means of a channel 88 formed between the mixing block 16 and the hot air block 18. An air inlet 89 is provided in the mixing block 14 which is connected to the recess 85 through a passage 91. The air flow through channel 88 is controlled to maintain a constant temperature in the combustion chamber. The venturi block 14, combustion chamber block 16 and exit block 18 are interconnected by bolts 90 and nuts 92.

The distinguishing feature of the air heater is contained in the burner core assembly 20. As mentioned previously, the air fuel mixture is forced into the core assembly after exiting the tapered venturi passage 30. In order to achieve clean combustion, it is necessary to thoroughly mix the air and gas. One feature of the burner core assembly 20 is the metal matt 40 and the set of mixing screens 42 and 46. These screens provide additional mixing of the air and gas after exiting the venturi 30. Mixing the flow of gas assures a higher probability that the oxygen and methane molecules will come into contact with each other in the combustion zone 33. The metal matt 40 slows down the flow and provides the combustion reaction more time to take place. These two factors work together to allow the combustion reaction to become more fully completed. The net result is that there will be less unburned fuel, CO and NOX emissions in the product stream.

The porous metal matt 40 located at the base of the combustion zone 33 promotes clean combustion in several ways.

(a) In the same way that the mixing plates slowed and mixed the fuel air mixture the metal matt further mixes and slows the flow.

(b) The typical one step combustion reaction is really a chain reaction with over 200 intermediate steps. In these steps, free radicals are formed (e.g. H2, NO2, NO, O, and O2). Through thermal and mixing effects, the metal matt 40 promotes the recombining of these free radicals into the H2O, CO2, and N2 species that are desired as combustion products. The matt also reduces thermal NOX.

Thus, it should be apparent that there has been provided in accordance with the present invention a gas/air fired heater that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A gas fired low emission air heater, the heater comprising:

a combustion chamber, a venturi block mounted on an inlet end of the combustion chamber, a tapered venturi passage formed in the venturi block having a narrow venturi passage inlet end and a less narrow venturi passage outlet end in fluid communication with the combustion chamber, an air inlet nozzle aligned with said venturi passage and positioned with respect to the venturi passage such that an annular gap is formed between the air inlet nozzle and the narrow venturi passage inlet end, an annular flange formed around said nozzle and having a plurality of openings formed therethrough for directing a gas into the venturi passage through the annular gap formed between the air inlet nozzle and the venturi passage inlet end;

a discharge nozzle mounted on a discharge end of the combustion chamber, a metal matt assembly mounted in said combustion chamber, and a spark plug mounted in said combustion chamber for igniting a gas/air mixture prior to discharge of heated air through the discharge nozzle.

2. The heater according to claim 1 wherein said metal matt assembly includes at least one perforated mixing plate and a metal matt aligned with said at least one mixing plate.

3. The heater according to claim 2 including a dilution air ring formed around the combustion chamber for admitting air into the discharge end of the combustion chamber to maintain a constant temperature in the combustion chamber.

4. The air heater according to claim 1 including a flame sensor mounted in said combustion chamber to sense the presence of a flame in the combustion chamber.

5. A gas/air heater comprising:

a combustion chamber block having a combustion chamber formed therein, a venturi block mounted on an upstream side of the combustion chamber block and having a tapered venturi passage formed therein in fluid communication with the combustion chamber, an air inlet nozzle mounted on the venturi block and having an air passage operatively connected to the venturi passage and a gas passage operatively connected to the air passage for mixing a gas with air at the inlet to the venturi passage such that a gas/air fuel mixture is flowable through the venturi passage into the combustion chamber, a burner core assembly mounted in one end of the combustion chamber, the burner core assembly including a frame, a woven metal matt mounted in the frame to slow a flow of the fuel mixture into the combustion chamber, and a pair of perforated mixing plates mounted in the frame upstream from the metal matt.

* * * * *